US008197216B2

(12) United States Patent
Wang

(10) Patent No.: US 8,197,216 B2
(45) Date of Patent: Jun. 12, 2012

(54) QUICK ASSEMBLY BLADES FOR A CEILING FAN

(75) Inventor: Cliff Wang, Tanzih Township, Taichung County (TW)

(73) Assignee: Air Cool Industrial Co., Ltd., Taichung County (JP)

( * ) Notice: Subject to any disclaimer, the term of this patent is extended or adjusted under 35 U.S.C. 154(b) by 1248 days.

(21) Appl. No.: 11/938,284

(22) Filed: Nov. 11, 2007

(65) Prior Publication Data

US 2009/0123287 A1 May 14, 2009

(51) Int. Cl.
*F04D 29/34* (2006.01)
*F04D 29/64* (2006.01)

(52) U.S. Cl. ..... 416/210 R

(58) Field of Classification Search ..... 416/210 R, 416/214 R

See application file for complete search history.

(56) References Cited

U.S. PATENT DOCUMENTS

| | | | | |
|---|---|---|---|---|
| 6,010,306 | A * | 1/2000 | Bucher et al. | 416/210 R |
| 6,309,183 | B1 * | 10/2001 | Bucher et al. | 416/210 R |
| 6,336,792 | B1 * | 1/2002 | Bucher et al. | 416/210 R |
| 6,352,409 | B1 * | 3/2002 | Blateri et al. | 416/207 |
| 6,371,729 | B1 * | 4/2002 | Tseng | 416/210 R |
| 6,652,236 | B2 * | 11/2003 | Hai | 416/206 |
| 6,666,652 | B2 * | 12/2003 | Bucher et al. | 416/210 R |
| 6,802,694 | B2 * | 10/2004 | Bucher et al. | 416/210 R |
| 6,821,091 | B2 * | 11/2004 | Lee | 416/210 R |
| 6,840,739 | B2 * | 1/2005 | Cortez et al. | 416/210 R |
| 6,902,374 | B2 * | 6/2005 | Pearce | 416/5 |
| 6,932,576 | B2 * | 8/2005 | Bird | 416/207 |

* cited by examiner

*Primary Examiner* — Edward Look
*Assistant Examiner* — Sean J Younger
(74) *Attorney, Agent, or Firm* — Ming Chow; Sinorica, LLC

(57) ABSTRACT

Quick assembly blades for a ceiling fan at least include a blade bracket, a blade and a clamping member. The clamping member is composed of a base plate and a top plate. A rear portion of the base plate has an elastic supporting plate corresponding to a locking plate provided in a rear portion of the top plate, so that the base plate and the top plate can axially move closer to each other to keep a leaning portion of the supporting plate blocked by a locking portion formed inside the locking plate, thus enabling the blade quickly assembled and firmly clamped on the blade bracket by the clamping member.

3 Claims, 5 Drawing Sheets

QUICK ASSEMBLY BLADES FOR A CEILING FAN

BACKGROUND OF THE INVENTION

1. Field of the Invention

This invention relates to a ceiling fan, particularly to one with blades able to be quickly and firmly assembled on blade brackets.

2. Description of the Prior Art

Commonly, as disclosed in U.S. Pat. No. 6,802,694, ⌈QUICK ASSEMBLY BLADES FOR CEILING FANS⌋, it is provided with elastic blocking plates installed on blade brackets to be elastically inserted in the ends of blades without any additional fastening components. Actually, the blades can not be steadily fixed on the blade brackets. In addition, as disclosed in U.S. Pat. No. 6,652,236, ⌈FAN BLADE ASSEMBLY AND METHOD OF ASSEMBLING⌋, although each of its blades is tightly fastened by an independent clamp plate, it is not ideal for configuration and assembly as its elastic blocking plates are additionally installed on the clamp plate.

SUMMARY OF THE INVENTION

The objective of this invention is to offer quick assembly blades for a ceiling fan.

The main characteristics of the invention are a blade bracket, a blade and a clamping member. The blade bracket is provided with three projections to correspond to holes bored on the blade. The clamping member is composed of a base plate and a top plate. Corresponding to the holes, a recess and two holes provided in the base plate and three locking holes provided in the top plate are employed to be inserted by the projections. Each of the locking holes has a round hole and a neck member. A rear portion of the base plate is provided with an elastic supporting plate to correspond to a locking plate provided in a rear portion of the top plate, so that each corresponding holes of the base plate and locking holes of the top plate can be passed through by a positioning element. And, the top plate can be engaged with the base plate to axially move closer to each other, keeping a head of the positioning element restricted on the neck member of the locking hole, and keeping a leaning portion of the supporting plate blocked by a locking portion of the locking plate, thus enabling the blade quickly assembled and firmly clamped on the blade bracket by the clamping member.

BRIEF DESCRIPTION OF DRAWINGS

This invention is better understood by referring to the accompanying drawings, wherein.

DETAILED DESCRIPTION OF THE PREFERRED EMBODIMENT

Figure 1:
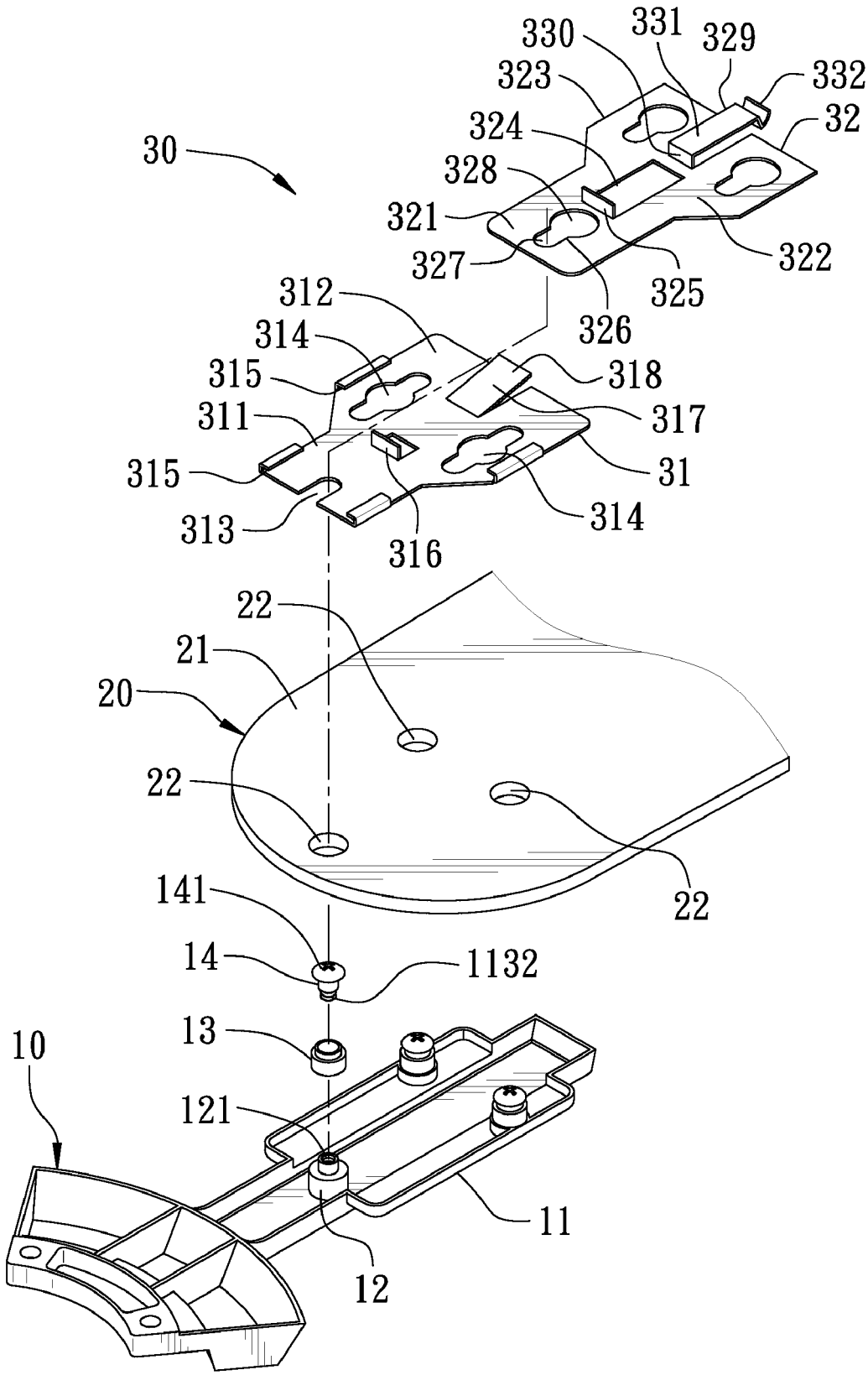
FIG. 1 is an exploded perspective view of a preferred embodiment of quick assembly blades for a ceiling fan in the present invention.
Figure 2:
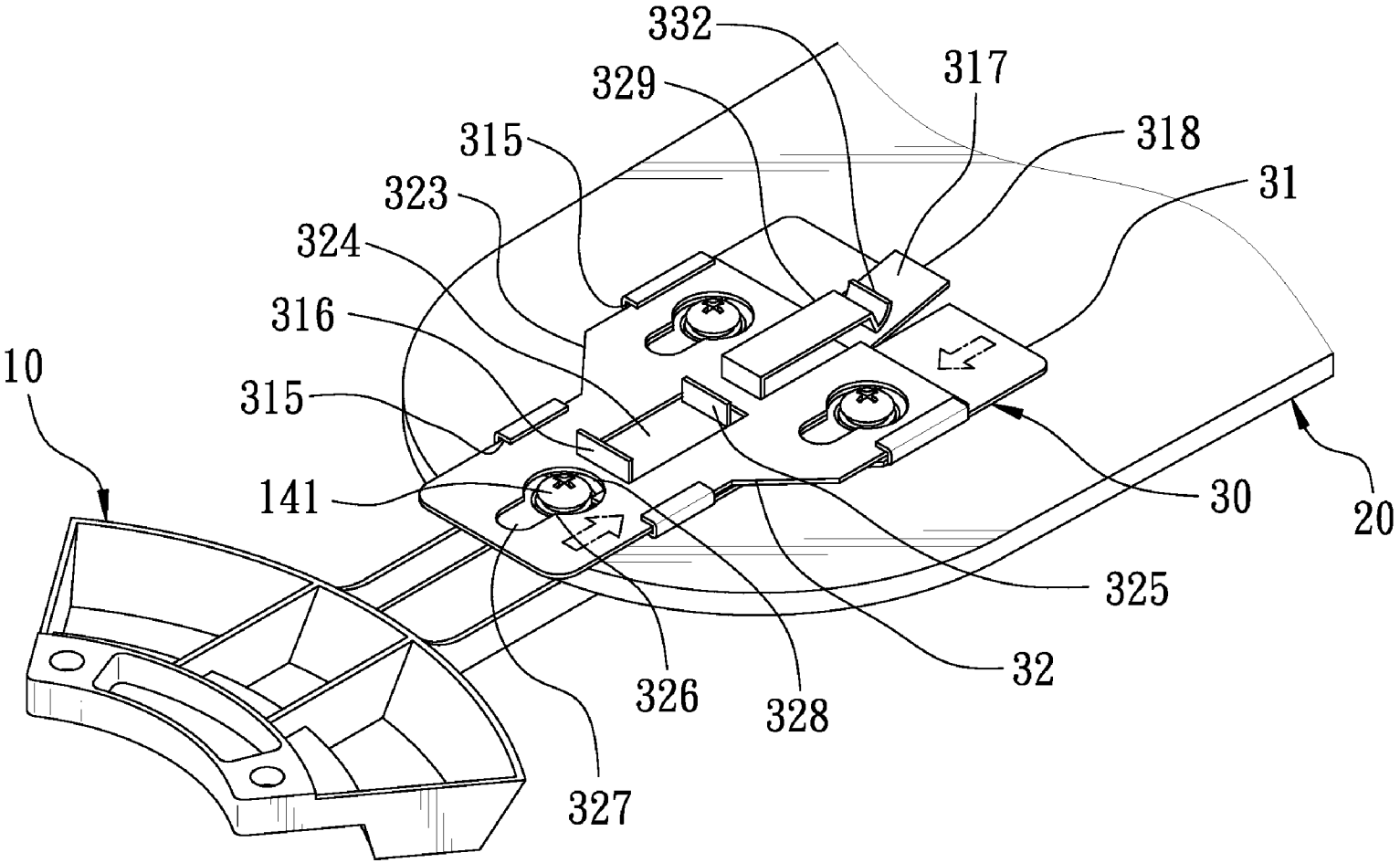
FIG. 2 is a perspective view of the preferred embodiment of quick assembly blades for a ceiling fan in the present invention, showing it is being assembled.

As shown in FIGS. 1 and 2, a preferred embodiment of quick assembly blades for a ceiling fan in the present invention includes a blade bracket 10, a blade 20 and a clamping member 30.

The blade bracket 10 is provided with a blade base 11 formed at its end, which is protruded with three projections 12 spaced apart equidistantly. Each projection 12 is provided with a threaded hole 121 formed in its top, annularly mounted with a rubbery sleeve 13. A positioning element 14 is employed to threadably engage with the threaded hole 121 on the top of the projection 12, having a head 141 with a larger diameter.

The blade 20 is provided with a connecting portion 21 formed at its front end for being installed on the blade base 11, and three holes 22 bored on the connecting portion 21 to be correspondingly inserted by the projections 12. And, the positioning element 14 is inserted into the hole 22 to keep the head 141 staying on the top of the hole 22.

Figure 3:
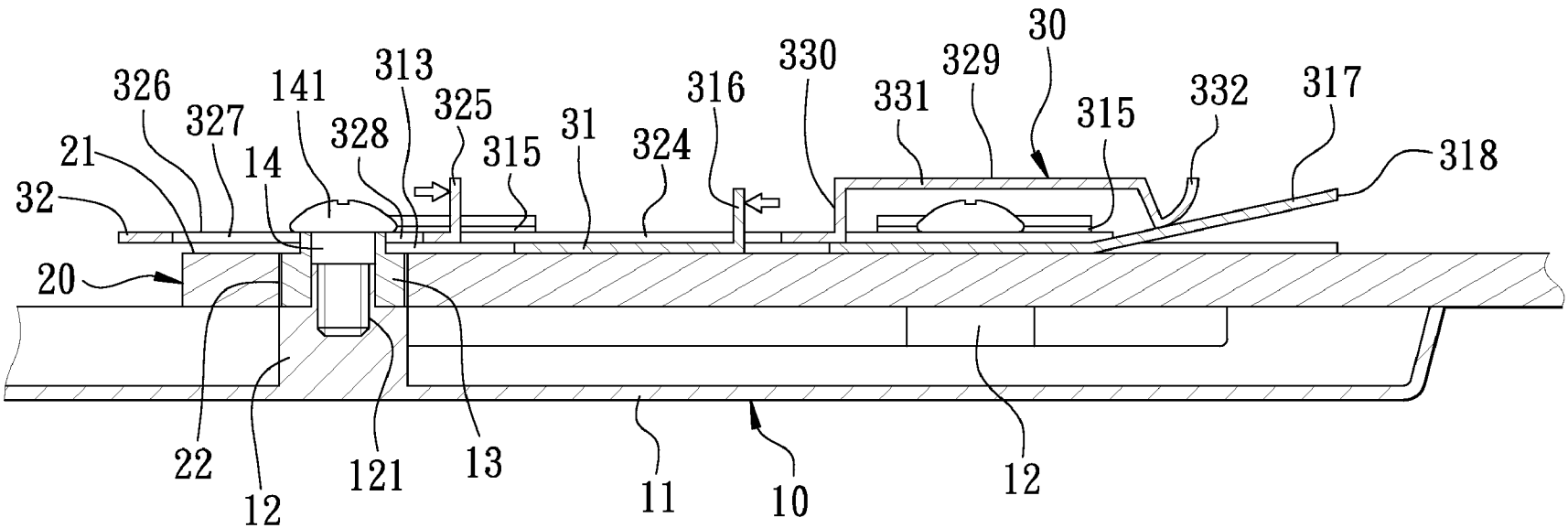
FIG. 3 is a side cross-sectional view of the preferred embodiment of quick assembly blades for a ceiling fan in the present invention, showing it is being assembled.

The clamping member 30, additionally referring to FIG. 3, is composed of a base plate 31 and a top plate 32.

The base plate 31 is provided with a front portion 311, a rear portion 312 having a width wider than that of the front portion 311, a recess 313 formed at the front center of the front portion 311, and a key-shaped hole 314 bored at two sides of the rear portion 312 respectively. The recess 313 and the holes 314 are corresponding to the holes 22. Respectively formed at two side edges of each of the front port ion 311 and the rear portion 312 is a sliding groove 315. A first pushing plate 316 is projected upwards at a location between the front portion 311 and the rear portion 312. In addition, the base plate 31 is also provided with a supporting plate 317 elastically formed at the rear of the rear portion 312 to be gradually lifted up backwards, and a leaning portion 318 formed at the rear end of the supporting plate 317 with a higher level than the rear portion 312.

The top plate 32 is provided with a front portion 321, a rear portion 322 having a width wider than that of the front portion 321, a rim 323 formed at two sides of the front portion 321 and the rear portion 322 respectively for movably engaging with the sliding groove 15, a rectangular hole 324 bored across the front portion 321 and the rear portion 322 for the first pushing plate 316 to pass through, and a second pushing plate 325 projected upwards from the front end of the hole 324. Bored in the front portion 321 and the rear portion 322 to correspond to the holes 22 are three locking holes 326, which are respectively provided with a neck member 327 and a round hole 328 communicating with the neck hole 327 and having a diameter larger than the width of the neck member 327. And, integrally extended from the rear of the rear portion 322 is an elastic locking plate 329, which is provided with a vertical portion 330 extended upwards from the rear portion 322, a horizontal portion 331 vertically bent from the vertical portion 330, and a V-shaped locking portion 332 formed at the rear of the horizontal portion 331. The base plate 31 and the top plate 32 are integrally made of metal or plastics.

Figure 4:
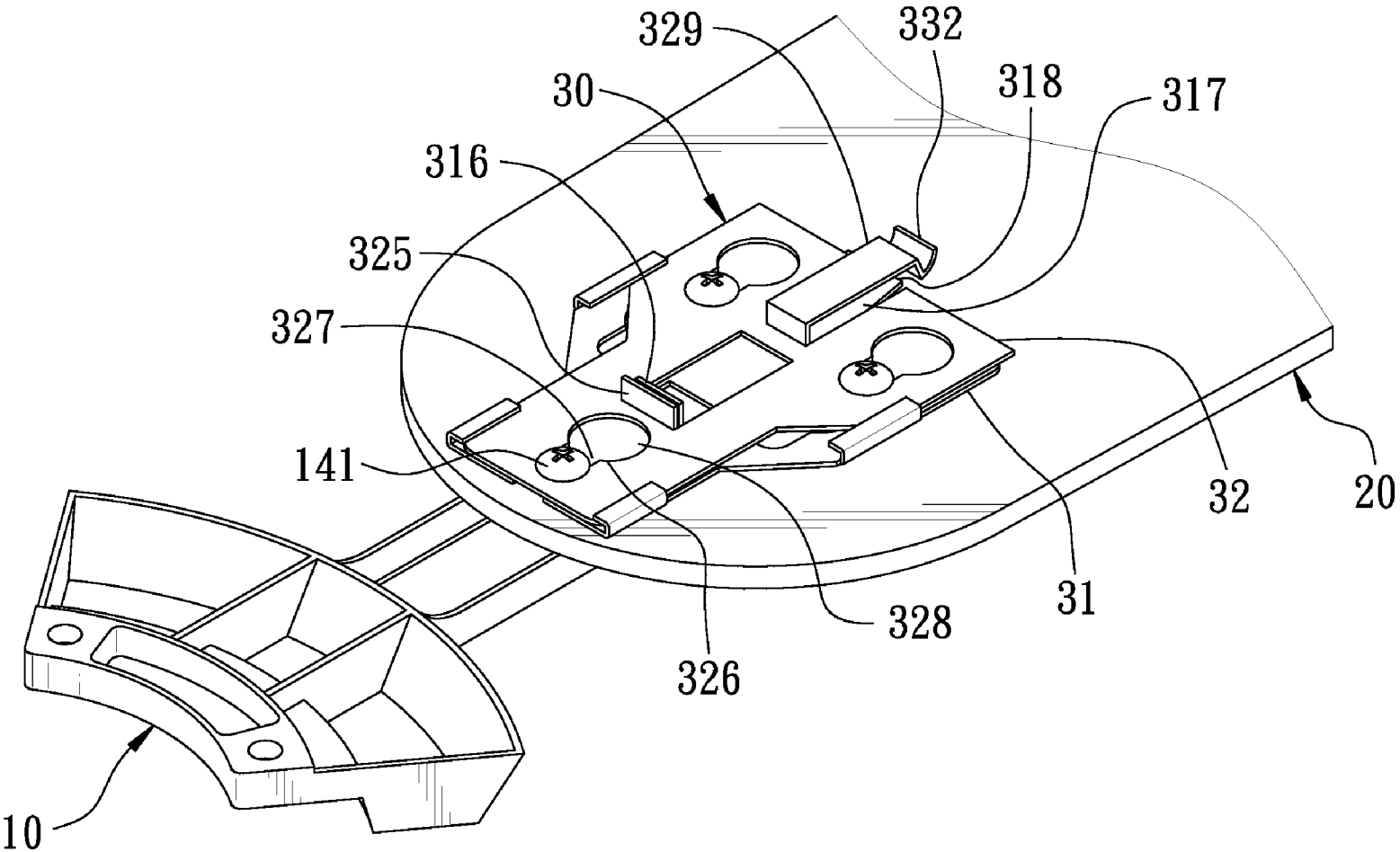
FIG. 4 is a perspective view of the preferred embodiment of quick assembly blades for a ceiling fan in the present invention, showing it has been assembled.
Figure 5:
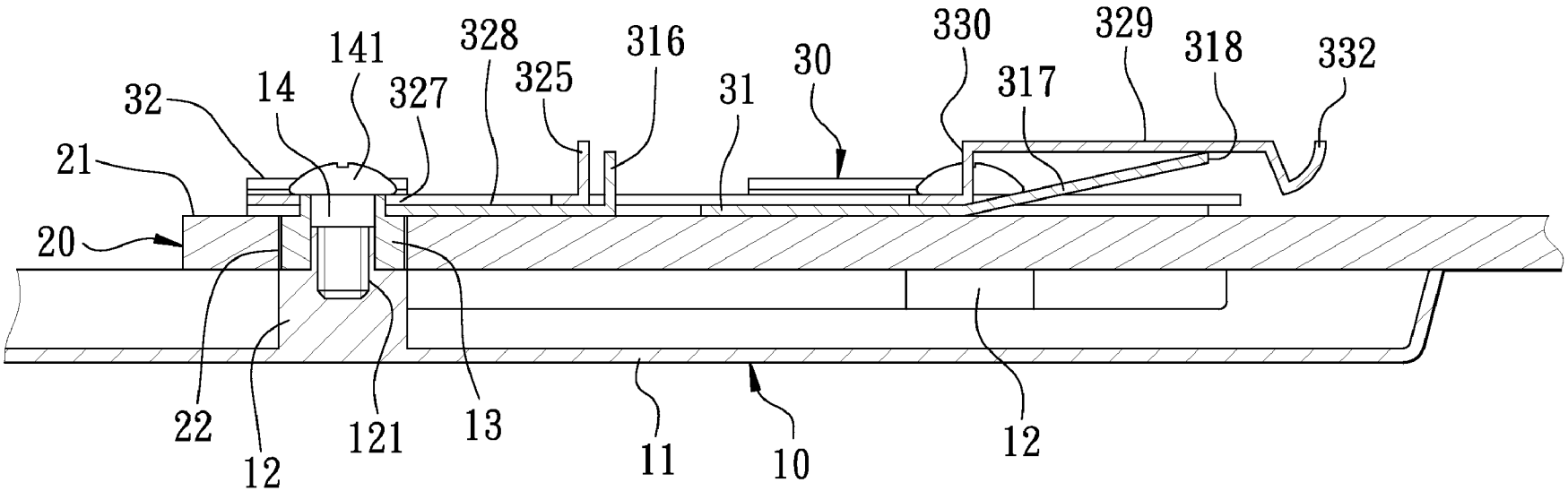
FIG. 5 is a side cross-sectional view of the preferred embodiment of quick assembly blades for a ceiling fan in the present invention, showing it has been assembled.

In assembling, as shown in FIGS. 2 and 3, when the blade 20 is to be assembled on the blade bracket 10, first, the blade 20 and the clamping member 30 are sequentially put on the blade bracket 10 to enable the projections 12 to pass through the holes 22, the holes 314 and the round holes 328 of the locking holes 326. Next, start to push the first pushing plate 316 and the second pushing plate 325 in reverse direction to get close to each other. By the time, the first pushing plate 316 is moved axially along the hole 324 to enable the base plate 31 and the top plate 32 to be correspondingly moved axially. And, as shown in FIGS. 4 and 5, the recess 313 of the base plate 31 and the necks 327 and the round holes 328 of the locking holes 326 are simultaneously moved to keep the bars 12 locked in the neck holes 327 of the locking holes 326 and the recess 313. The heads 141 of the positioning elements 14 are therefore restricted on the neck member 327 to keep the blade 20 fixed on the blade racket 10 because they have a diameter larger than the width of the neck member 327. Meanwhile, the locking plate 329 and the supporting plate 317 are also moved closely to keep the leaning portion 318 of the supporting plate 317 positioned inside the locking portion 332 of the locking plate 329, enabling the base plate 31 and the top plate 32 securely fixed together to make the blade 20 firmly fastened on the blade bracket 10 by the clamping member 30.

The advantages of the invention are described below as can be seen from the foresaid description.

With the leaning portion 318 of the base plate 31 blocked by the locking portion 332 of the top plate 32 to keep the base plate 31 and the top plate 32 completely tightened to power fully press the blade 20 upon the blade bracket 10 firmly, the blade 20 can be quickly assembled and firmly clamped on the blade 10 bracket.

While the preferred embodiment of the invention has been described above, it will be recognized and understood that various modifications may be made therein and the appended claims are intended to cover all such modifications that may fall within the spirit and scope of the invention.

What is claimed is:

1. Quick assembly blades for a ceiling fan comprising:

a blade bracket provided with a blade base formed at its end that is protruded upward with three projections spaced apart properly;

each of said projections threadably engaged with a positioning element which has a head at its top;

a blade provided with a connecting portion formed at its front end for being installed on said blade base, said connecting portion bored with three holes to be correspondingly inserted by said projections, said positioning element plugged in each of said holes to keep its head remained on each of said holes;

a clamping member composed of a base plate and a top plate, said base plate bored with a recess and two holes to correspond to said holes and provided with a rear portion possessing an elastic supporting plate that has its end formed with a leaning portion having a level slightly higher than that of said rear portion, said top plate employed to movably engage with said base plate and provided with three locking holes to correspond to said holes, each of said locking holes provided with a round hole and a neck member communicating with each other, an elastic locking plate integrally extended from a rear portion of said top plate and having a locking portion formed at its end;

said base plate is provided with a front portion and said rear portion wider than said front portion, a recess formed at a front center of said front portion, a key-shaped hole bored at two sides of said rear portion respectively, two side edges of each of said front portion and said rear portion formed of a couple of sliding grooves, a first pushing plate projected upwards at a location between said front portion and said rear portion; said top plate provided with a front portion and a rear portion wider than said front portion, a rim formed at two sides of said front portion and said rear portion respectively for movably engaging with said sliding groove, a rectangular hole bored across said front portion and said rear portion for said first pushing plate to pass through; and a second pushing plate projected upwards from a front end of said hole.

2. The quick assembly blades for a ceiling fan as claimed in claim 1, wherein said locking plate is provided with a vertical portion extended upwards from said rear portion of said top plate, a horizontal portion bent from said vertical portion, a V-shaped locking portion formed at a rear of said horizontal portion.

3. The quick assembly blades for a ceiling fan as claimed in claim 1, wherein said positioning element is a screw, each of said projections provided with a threaded hole formed in its top and annularly mounted with a sleeve for said screw to pass through to engage with said threaded hole.

* * * * *